United States Patent [19]

Greene

[11] 4,452,454

[45] Jun. 5, 1984

[54] MANIPULATABLE GAME

[76] Inventor: Wilton R. Greene, 426 Hayne St., Woodruff, S.C. 29388

[21] Appl. No.: 404,348

[22] Filed: Jul. 30, 1982

[51] Int. Cl.[3] ..... A63F 9/08

[52] U.S. Cl. ..... 273/153 S; 273/281

[58] Field of Search ..... 273/153 S, 281

[56] References Cited

U.S. PATENT DOCUMENTS 507,215 10/1893 Churchill ..... 273/153 S
3,726,527 4/1973 Schauffler ..... 273/256

FOREIGN PATENT DOCUMENTS 48795 4/1982 European Pat. Off. ..... 273/153 S
G8110092 10/1981 Fed. Rep. of Germany ... 273/153 S
WO81/00101 1/1982 PCT Int'l Appl. ..... 273/153 S
2088728 6/1982 United Kingdom ..... 273/153 S

*Primary Examiner*—Anton O. Oechsle
*Attorney, Agent, or Firm*—Dority & Flint

[57] ABSTRACT

A manipulatable game which includes a spherical support member which has a plurality of circular tracks extending about the surface thereof which intersect each other at right angles. Movable members are carried on the tracks for being rotated about the spherical support member and shifted from one track to another at a junction of two of the tracks so that the movable members can be arranged according to predetermined patterns. The movable members are of different colors and have characters of the alphabet printed thereon.

7 Claims, 9 Drawing Figures

MANIPULATABLE GAME

BACKGROUND OF THE INVENTION

Games utilizing large square blocks made up of a plurality of smaller blocks which can be manipulated along various axes have become very popular in recent times. One particular game has been referred to as the "Rubik Cube" upon which a Hungarian patent application No. 170062 was filed on Feb. 28, 1978. The side walls of the smaller blocks forming the "Rubik Cube" have different colors, and the object of the game is to align all of the common colors on one side of the enlarged cube by manipulating groups of cubes about various axes.

Another puzzle or game wherein square blocks are manipulated about a board is disclosed in U.S. Pat. No. 785,665 granted on Mar. 21, 1905. In U.S. Pat. No. 3,081,089, there is disclosed a manipulatable toy and more particularly a mechanical puzzle which includes a plurality of varied colored parts which are movable relative to each other to form various patterns.

While the above puzzles, particularly the "Rubik Cube," have become very popular in recent years, the novelty of the game often diminishes, and it is desirable to produce new games requiring different skills.

SUMMARY OF THE INVENTION

The manipulatable game constructed in accordance with the present invention includes a substantially spherical support member which has a plurality of square members that can be manipulated about three different tracks carried on the support member. At the junction of two tracks, the squares can be shifted from one particular track to another.

In one particular embodiment, the tracks include a pair of spaced flanges extending circumferentially about the sphere. The movable members have grooves complementary in shape to the flanges for permitting the movable members to be shifted along the flanges.

In order to permit the members to be moved over a junction of two tracks wherein the flanges do not extend, bearings are carried in the grooves in the sides of the movable members next adjacent the sides of the movable members in which the flanges of the tracks extend.

Indicia of different kinds can be printed on the movable members and, in one particular game, the movable members are colored differently and also characters of the alphabet are printed thereon so that different types of games can be played.

In one particular game, the colored members are scrambled, and the player has to return them to an original position within a predetermined period of time.

Another particular game that can be played using the toy constructed in accordance with present invention is to construct words using the letters provided on the movable members by moving the movable members about the three tracks extending around the sphere.

Still another game using dice can be played wherein the players are permitted a certain number of moves of the movable members responsive to the throw of the die.

Accordingly, an important object of the present invention is to provide an interesting and simple game for testing skills of players.

BRIEF DESCRIPTION OF THE DRAWING

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 4:
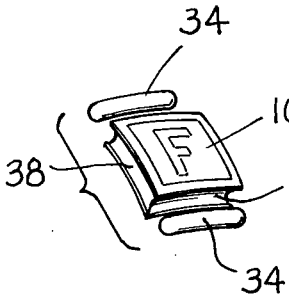
FIG. 4 is an enlarged perspective view illustrating one of the movable member used in the game.
Figure 1:
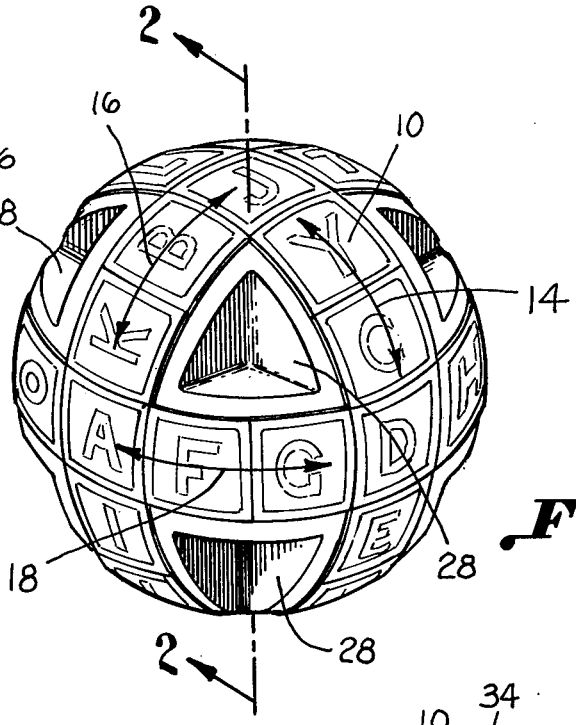
FIG. 1 is a perspective view illustrating a toy constructed in accordance with the present invention.

There is disclosed in FIG. 1 a manipulatable toy or game which includes movable members 10 carried on tracks which extend about the surface of a spherical support member 12 in three different directions. On the surface of each of the movable members 10 is indicia representing the alphabet. On one particular device, there is a complete alphabet, two extra vowels and two white blocks which may be used to represent any letter. The background for each of the movable members are colored with six different colors. In FIG. 4, there is illustrated one particular movable member 10 which has the letter F printed thereon with a blue colored background. In playing games, it is desired that the movable members 10 be moved about the tracks in the directions shown by the three arrows 14, 16, and 18. The movable members may be shifted from one track to another at a junction of two tracks so that the order in which a letter appears on a particular track can be changed. This enables the player of the game to spell out various words and to make different color arrangements of the movable blocks.

Figure 5:
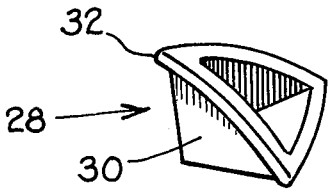
FIG. 5 is an enlarged perspective view showing a wedge forming part of the game.
Figure 2:
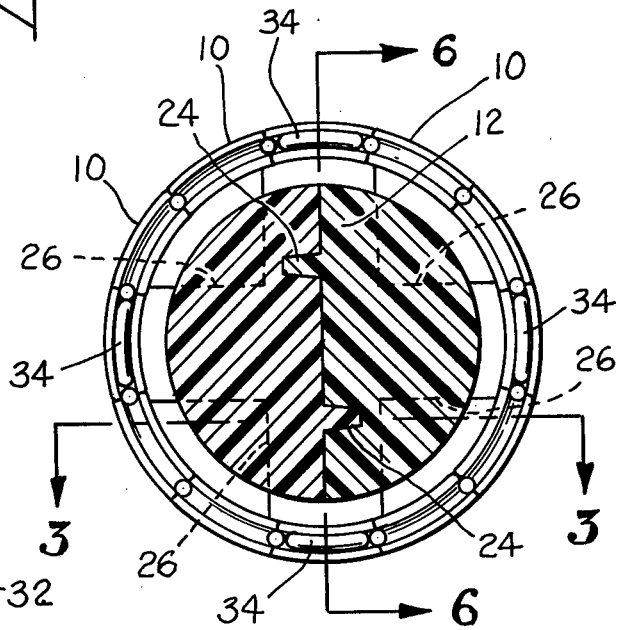
FIG. 2 is a sectional view taken along line 2—2 of FIG. 1.
Figure 3:
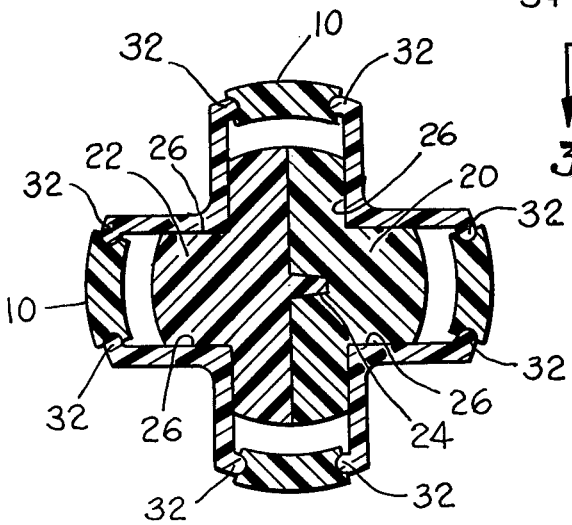
FIG. 3 is a sectional view taken along line 3—3 of FIG. 2.

The spherical support member 10 is constructed of a pair of semi-circular elements 20 and 22 which are secured together by gluing posts 24 extending from one semi-circular member into the other semi-circular member. The reason that the spherical support member 12 is constructed in two halves is to facilitate the assembling of the device. Each of the semi-circular halves 20 and 22 has four equally spaced three-sided equilateral sockets 26 which are in the shape of a pyramid provided therein. These sockets are for receiving wedge-shaped members 28 such as shown in FIG. 5. The wedge-shaped members 28 have a base portion 30 complementary in shape with the sockets 26 and include three equilateral sides in the shape of a pyramid so they can nest and be glued within the sockets 26. Equilaterally, spherically triangular-shaped flanges 32 are carried by the base portion. The flanges 32 of two spaced wedges 28 define the tracks upon which the movable square members 10 ride. As a result of the tracks being formed by wedges having the flanges 32 adjacent the outer periphery thereof, there is a break at the junction of the two tracks. This would normally present a problem in maintaining the square movable members on the surface of the sphere, however, cylindrical coupling members 34 are carried within grooves 36 provided in the side walls of the movable members so that the cylindrical bearings or coupling members 34 span the space between adjacent movable members holding them in alignment with the track. The adjacent side walls of the movable members 10 also have arcuate grooves 38 provided therein so that they can ride on the flanges 32 as shown in FIG. 3. In FIG. 2, the cylindrical bearings 34 are shown extending between adjacent movable members in a particular track.

When the group of movable members 10 are moving in a track defined by the flanges 32 of a pair of wedge-shaped members 28, the movable members are supported by the flanges 32 until the movable member reaches an intersection. At the intersection as in the case of the movable member 10 with the letter J thereon, as shown in FIG. 1, the movable member is supported by four bearings 34. If the movable member 10 with the letter J thereon is moved from the intersection in the direction of arrow 14, then the two bearings 34 on the side of the member with the J thereon, remain at the intersection since the flanges 32 prevent them from moving. However, the bearing at the top and bottom of the movable member 10 with the J thereon, move with the member. There is a total of thirty-six of the bearings 34. The bearings 34 are only permitted to move in a direction perpendicular to their longitudinal axis.

Figure 6:
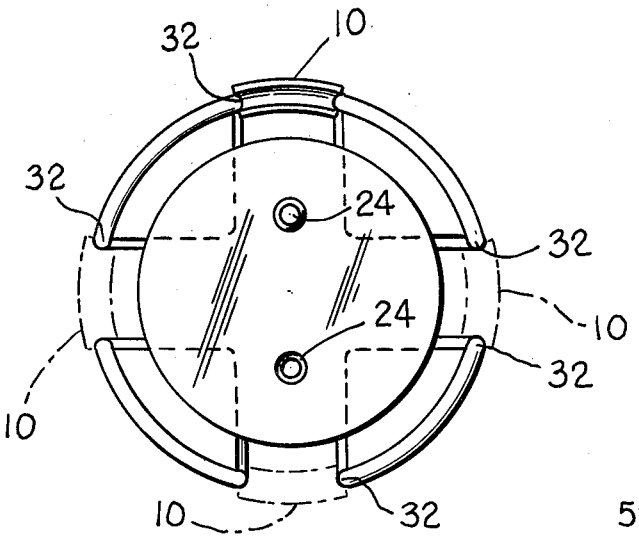
FIG. 6 is a sectional view taken along the line 6—6 of FIG. 2.

In FIG. 6, the manner in which the movable members 10 ride on the flanges of the wedges 28 is shown.

Figure 7:
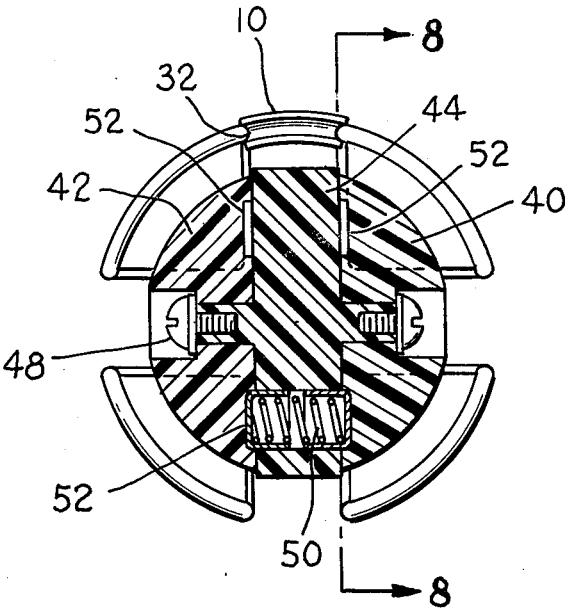
FIG. 7 is a sectional view of a modified form of the invention.
Figure 8:
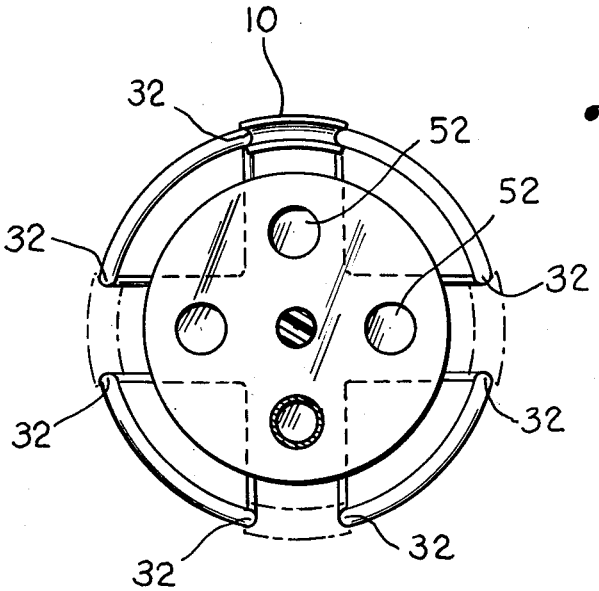
FIG. 8 is a sectional view taken along line 8—8 of FIG. 7.
Figure 9:
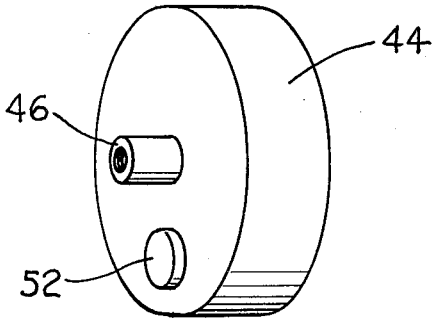
FIG. 9 is a perspective view of the central disk of the modified form of the invention.

In FIGS. 7–9, there is illustrated a modified form of the invention. In this particular device, the spherical support member includes three separate pieces. It includes a pair of spaced semi-circular members 40 and 42 which have a disk 44 provided therebetween. The disk 44 has hubs 46 extending outwardly therefrom on the axis thereof. This permits the semi-circular members 40 and 42 to be rotated relative to the semi-circular disk 44 for redefining the tracks extending about the surface of the spherical support.

The semi-circular members 40 and 42 are rotatably secured to the hubs 46 of the disk by means of bolts 48. Spring-loaded detents 50 are carried in a disk-shaped member so that the semi-circular members can be rotated to four different positions controlled by recess sockets 52 provided in the inner surfaces of the semi-circular members.

When playing the game, the movable members which have letters positioned thereon can be shifted about three different tracks, and when it is desired to shift a letter or movable member from one particular track to another, it is brought to the junction of two tracks and at that point, it is shifted 90° from the normal movement that it was being moved. The cylindrical coupling members extend between the movable members in the direction of normal movement about the track, and these cylindrical coupling members 34 prevent the movable members from falling off of the track at the junctions.

While a preferred embodiment of the invention has been described using specific terms, such description is for illustrative purposes only, and it is to be understood that changes and variations may be made without departing from the spirit or scope of the following claims.

What is claimed is:

1. A manipulatable game comprising:

a substantially spherical support member, a plurality of circular tracks extending about the surface of said spherical support member intersecting each other at right angles;

movable members carried on said tracks for being rotated about said spherical support member and shifted from one track to another track at a junction of two of said tracks so that said movable members can be arranged according to predetermined patterns;

each of said circular tracks including, (i) a pair of spaced circular flanges extending around said spherical support member, (ii) breaks occurring in said pairs of spaced circular flanges at the junction of two tracks, said movable members having four sides and being substantially square in shape;

grooves provided in each of four sides of said movable members complementary in shape with said flanges provided on said tracks so that said members are carried on said tracks in a tongue-and-groove relation; and elongated couplings carried in the grooves of adjacent members spanning the space provided between said adjacent members.

2. The manipulatable game as set forth in claim 1 further comprising:

said elongated coupling being cylindrical in shape and being shorter than the groove in a side wall.

3. The manipulatable game as set forth in claim 1 further comprising:

there are three circular tracks extending about the surface of said support member each intersecting the other at an angle of ninety degrees.

4. A manipulatable game comprising:

a substantially spherical support member;

a plurality of circular tracks extending about the surface of said spherical support member intersecting each other at right angles;

movable members carried on said tracks for being rotated about said spherical support member and shifted from one track to another track at a junction of two of said tracks so that said movable members can be arranged according to predetermined patterns;

a plurality of three sided sockets each being in the shape of a pyramid provided in said spherical support member;

a plurality of wedges having a base portion complementary in shape to said sockets inserted in said sockets; and equilaterally spherically triangular shaped flanges carried on said base portion defining said circular track.

5. The manipulatable game as set forth in claim 4 wherein there are eight equilateral three-sided sockets provided in the surface of said spherical support member and being equally spaced from each other; and there are eight wedges each having a base portion complementary in shape with said sockets inserted in respective sockets.

6. A manipulatable game comprising:

a support member;

a plurality of circular tracks extending about said support member intersecting each other at right angles at junction points;

each circular track including a pair of spaced flanges defining spherical grooves therebetween which run in three different directions about said support member;

a plurality of movable members having four sides of equal length;

grooves provided in each side of said movable members for receiving said flanges of said circular tracks so that said movable members can be shifted along said tracks and shifted from one track to another at said junction of said tracks, and elongated bearings carried in two of said grooves in the sides of said movable members for coupling adjacent movable members carried on a track together.

7. The manipulatable game as set forth in claim 6 further comprising:

said support member including (i) a pair of spaced semicircular members;

(ii) a disk carried between said semicircular members having axial hubs projecting outwardly therefrom;

(iii) means for rotatably supporting said semi-circular members on said hubs for redefining said tracks extending about said surface of said spherical support member.

* * * * *